US010610058B2

(12) United States Patent
Castillo

(10) Patent No.: US 10,610,058 B2
(45) Date of Patent: Apr. 7, 2020

(54) OVER THE TUB DOUBLE SIDED STEP STOOL

(71) Applicant: Odelia Castillo, Orange, CA (US)

(72) Inventor: Odelia Castillo, Orange, CA (US)

( * ) Notice: Subject to any disclaimer, the term of this patent is extended or adjusted under 35 U.S.C. 154(b) by 0 days.

(21) Appl. No.: 16/151,234

(22) Filed: Oct. 3, 2018

(65) Prior Publication Data

US 2019/0099043 A1 Apr. 4, 2019

Related U.S. Application Data

(60) Provisional application No. 62/567,856, filed on Oct. 4, 2017.

(51) Int. Cl.
*A47K 3/00* (2006.01)
*A47C 12/00* (2006.01)
*A47C 9/00* (2006.01)

(52) U.S. Cl.
CPC ..... *A47K 3/001* (2013.01); *A47C 9/00* (2013.01); *A47C 12/00* (2013.01)

(58) Field of Classification Search
CPC ..... E04H 4/144; A47K 3/001; A47C 9/00; A47C 12/00; A47C 12/02; A47C 16/02; A63B 9/00; A63B 2009/006; A63B 5/00
USPC ..... 182/118, 33, 33.4, 33.3; 4/555, 559, 4/561.1, 574.1, 604; D6/350, 352
See application file for complete search history.

(56) References Cited

U.S. PATENT DOCUMENTS

| | | | | |
|---|---|---|---|---|
| 2,871,914 | A * | 2/1959 | Timoney | A47D 13/04 482/52 |
| 5,641,034 | A * | 6/1997 | Calmeise | A47C 12/00 182/17 |
| 5,715,907 | A * | 2/1998 | Andret | E04H 4/144 182/115 |
| 6,115,857 | A * | 9/2000 | Bidegain | A47K 3/281 4/571.1 |
| 8,037,649 | B2 * | 10/2011 | Jakubowski | A01K 1/035 52/182 |
| 9,878,196 | B2 * | 1/2018 | Lin | A63B 21/16 |
| 9,889,339 | B2 * | 2/2018 | Douglass | A63B 5/11 |

* cited by examiner

*Primary Examiner* — Janie M Loeppke
(74) *Attorney, Agent, or Firm* — Pharar Patents & Intellectual Property; Andrew A. Pharar

(57) ABSTRACT

The present invention is directed to an over-the-tub double-sided step stool for providing a user, preferably a toddler or small child, with a means of un-assisted ingress and egress into a bathtub. The device may comprise an outer side and an inner side oriented such that they engage an outer and inner side, respectively, of a standard tub wall. Said outer and inner sides of the device may each further comprise a first step and a second step to provide elevation to a user of the device. Such outer and inner sides of the device may be connected to each other, whether permanently or removably, by a top step that may engage a top side of a standard tub wall. Said outer and inner sides of the device may further comprise a plurality of attachment receivers to which a plurality of non-slip foot attachments or suction foot attachments may be engaged to provide traction to the device.

14 Claims, 10 Drawing Sheets

OVER THE TUB DOUBLE SIDED STEP STOOL

TECHNICAL FIELD OF THE INVENTION

The present invention relates in general to step stools, and more specifically to an over-the-tub double-sided step stool.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Stairs comprise a class of well-known devices variously designed to achieve multiple different functions. Generally, stairs tend to be designed with two or more steps and are either self-supporting, for example when designed as an A-frame, or are supported by an additional structure, for example a ceiling or wall panel. In a bathroom setting stairs may be designed to assist in numerous functions, notably in aiding children or those otherwise unable with reaching above a sink or toilet. Stairs are also used in numerous applications relating to bathtubs. Such bathtub stairs tend to comprise one or two steps and may be affixed to a side of a bathtub or may be removably placed alongside a bathtub as needed. Such bathtub stairs may be used by toddlers or small children to enter a bathtub, though such a toddler or small child will then have no means of egress from said bathtub. A bathtub stair design comprising steps on both an outside and an inside of a bathtub would provide such an advantage over current designs.

It is known to have a stair device that may comprise a rigid combination of two or more steps that may be removably placed alongside a bathtub for ingress into said bathtub. Such stair devices may be commonly built from plastics or woods. Such designs, while allowing easy entry into a bathtub, though, do not also allow for easy exiting from said bathtub. Such devices are commonly termed "Bath Steps" or "Tub Stairs."

There is a need in the art for an over-the-tub double-sided step stool. Such a device may provide a user, preferably a toddler or small child, with a means of ingress into and egress from a bathtub. In a first embodiment such a device may comprise a solid one-piece main body incorporating a plurality of steps to provide elevation and a plurality of foot attachments to provide traction. In a second embodiment such a device may comprise a solid multi-piece design wherein the various components may be removably attached to one another.

It is to these ends that the present invention has been developed.

BRIEF SUMMARY OF THE INVENTION

To minimize the limitations in the prior art, and to minimize other limitations that will be apparent upon reading and understanding the present specification, the present invention describes an over-the-tub double-sided step stool.

It is an objective of the present invention to provide an over-the-tub double-sided step stool that may comprise a resilient material.

It is another objective of the present invention to provide an over-the-tub double-sided step stool that may comprise a one-piece design.

It is another objective of the present invention to provide an over-the-tub double-sided step stool that may comprise a multi-piece design.

It is another objective of the present invention to provide an over-the-tub double-sided step stool that may comprise a plurality of traction attachments.

It is another objective of the present invention to provide an over-the-tub double-sided step stool that may comprise a structural framework.

It is another objective of the present invention to provide an over-the-tub double-sided step stool that may comprise a plurality of non-slip surfaces.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE INVENTION

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

The various embodiments of the invention have advantageous features not present in conventional step stools. The over-the-tub double-sided step stool disclosed herein may provide a user, preferably a toddler or small child, with a means of un-assisted ingress into and egress from a bathtub. The device may comprise an outer side and an inner side oriented such that they engage an outer and inner side, respectively, of a standard tub wall. Said outer and inner sides of the device may each further comprise a first step and a second step to provide elevation to a user of the device. Such outer and inner sides of the device may be connected to each other by a top step, whether permanently in a one-piece design or removably in a multi-piece design, that may engage a top side of a standard tub wall. Said outer and inner sides of the device may further comprise a plurality of attachment receivers to which a plurality of non-slip foot attachments or suction foot attachments may be engaged to provide traction to the device.

Figure 1:
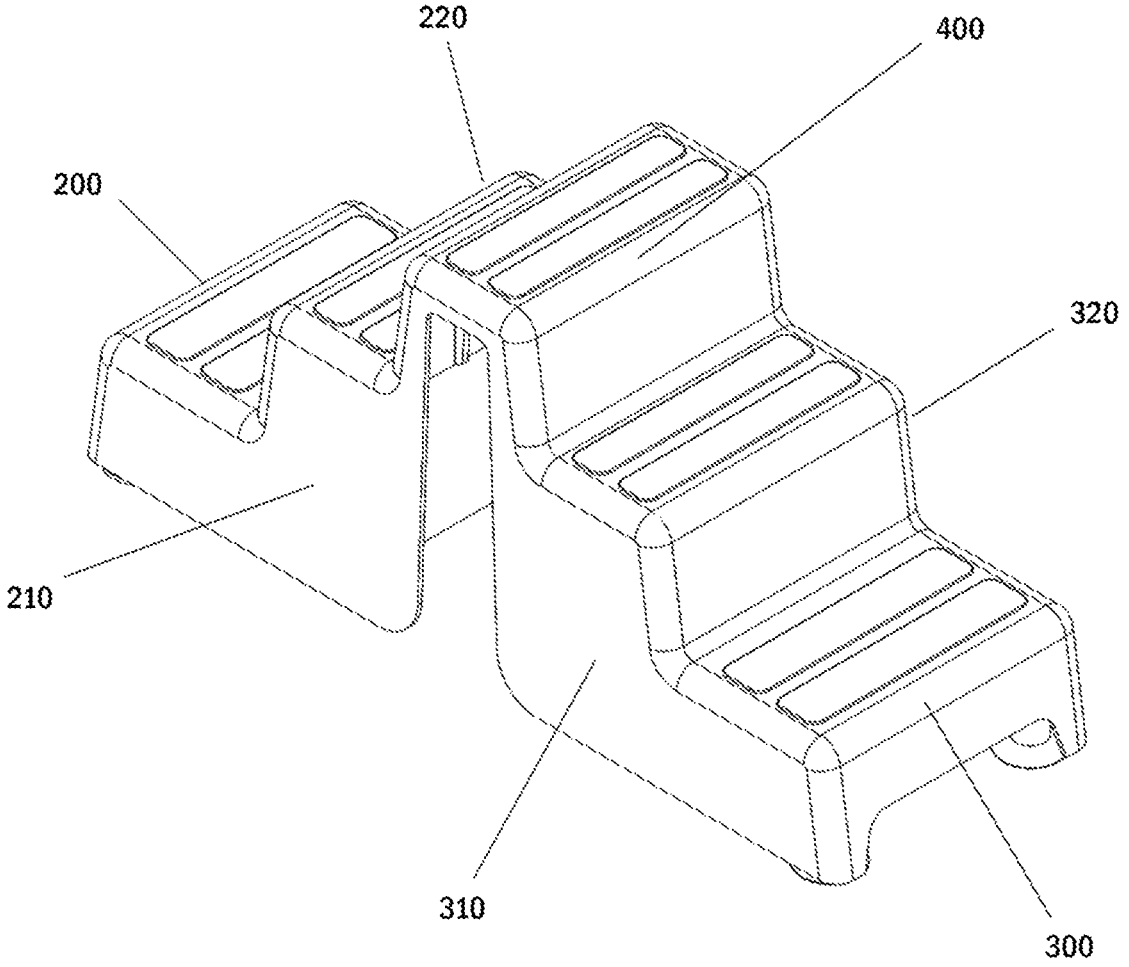
FIG. 1 illustrates top isometric view of a first embodiment of an over-the-tub double-sided step stool, as contemplated by the present disclosure.

The illustration of FIG. 1 illustrates top isometric view of a first embodiment of an over-the-tub double-sided step stool. The figure illustrates a main body, having an outer side 200 and an inner side 300. Said outer side 200 further comprises a first side 210 and a second side 220. Said inner side 300 further comprises a first side 310 and a second side 320.

By reference to the illustration in FIG. 1, the first embodiment disclosed herein may comprise a solid, one-piece main body consisting of various subcomponents, said subcomponents forming a cavity into which may be positioned a standard bathtub wall. Said subcomponents may be itemized as an outer side 200, an inner side 300, and a top step 400.

An outer side 200 of a main body may further comprise a first side 210 and a second side 220, said first side 210 and second side 220 forming a plurality of vertical endplates of said outer side 200. Said first side 210 and second side 220 may be attached at their distal and upper edges by a first step 230 of an outer side 200, and may be attached at their proximal and upper edges by a second step 230 of an outer side 200. Said proximal edge of said outer side 200 may form an outer edge of a cavity into which may be positioned a standard bathtub wall.

An inner side 300 of a main body may further comprise a first side 310 and a second side 320, said first side 310 and second side 320 forming a plurality of vertical endplates of said inner side 300. Said first side 310 and second side 320 may be attached at their distal and upper edges by a first step 330 of an inner side 300, and may be attached at their proximal and upper edges by a second step 330 of an inner side 300. Said proximal edge of said inner side 300 may form an inner edge of a cavity into which may be positioned a standard bathtub wall.

A top step 400 of a main body may be attached simultaneously to a proximal edge of both an outer side 200 and an inner side 300 such that said top step 400 may form an upper edge of a cavity into which may be positioned a standard bathtub wall.

Figure 2:
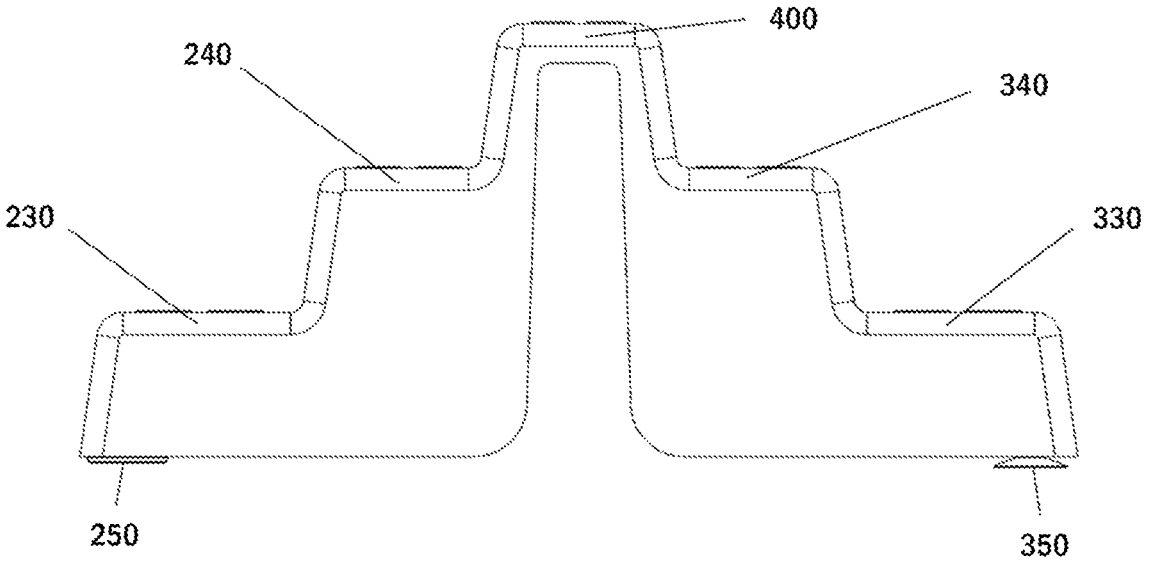
FIG. 2 illustrates a side view of a first embodiment of an over-the-tub double-sided step stool, as contemplated by the present disclosure.

The illustration of FIG. 2 illustrates a side view of a first embodiment of an over-the-tub double-sided step stool. The figure illustrates a first step 230 of an outer side 200 and a second step 240 of an outer side 200. Also shown are a first step 330 of an inner side 300 and a second step 340 of an inner side 300. The figure further illustrates a top step 400, a non-slip foot attachment 250 and a suction foot attachment 350.

Figure 3:
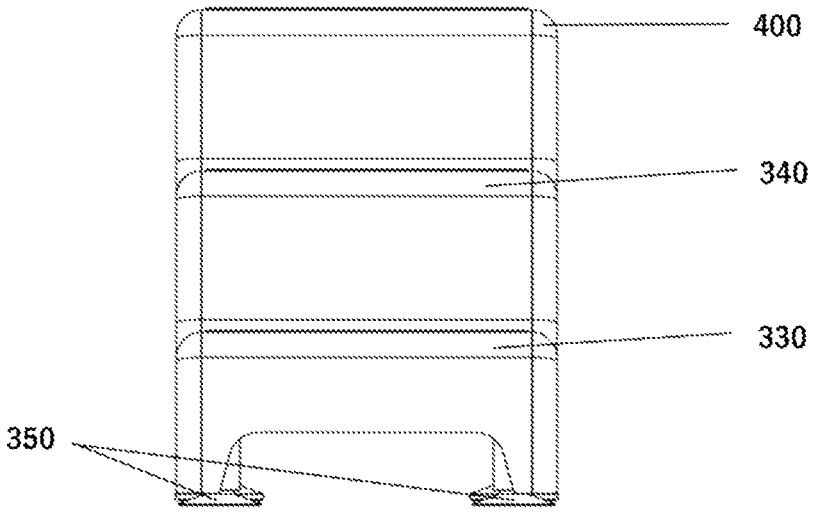
FIG. 3 illustrates a front view of a first embodiment of an over-the-tub double-sided step stool, as contemplated by the present disclosure.

The illustration of FIG. 3 illustrates a front view of a first embodiment of an over-the-tub double-sided step stool. The figure illustrates a first step 330 of an inner side 300 and a second step 340 of an inner side 300. The figure further illustrates a top step 400 and a plurality of suction foot attachments 350.

Figure 4:
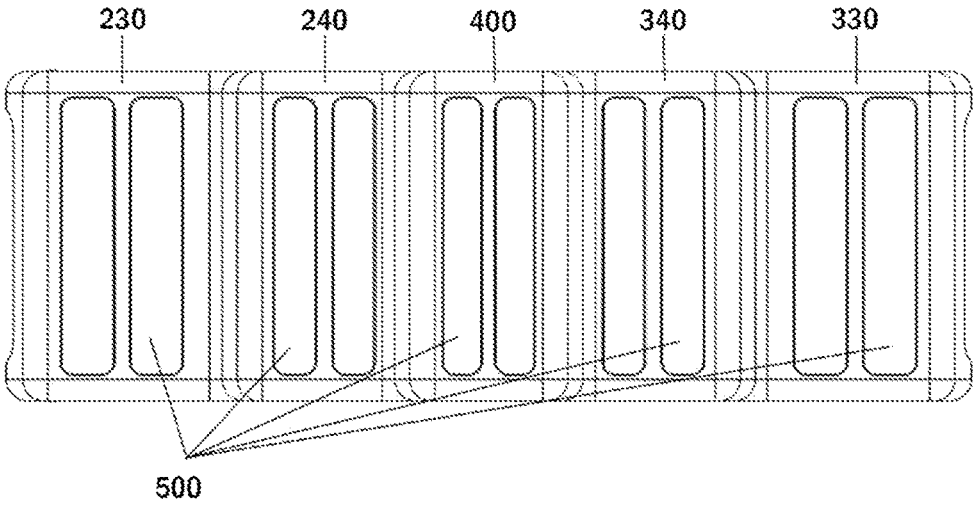
FIG. 4 illustrates a top view of a first embodiment of an over-the-tub double-sided step stool, as contemplated by the present disclosure.

The illustration of FIG. 4 illustrates a top view of a first embodiment of an over-the-tub double-sided step stool. The figure illustrates a first step 230 of an outer side 200, a second step 240 of an outer side 200, a first step 330 of an inner side 300, and a second step 340 of an inner side 300. The figure further illustrates a top step 400 and a plurality of non-slip surfaces 500.

Figure 5:
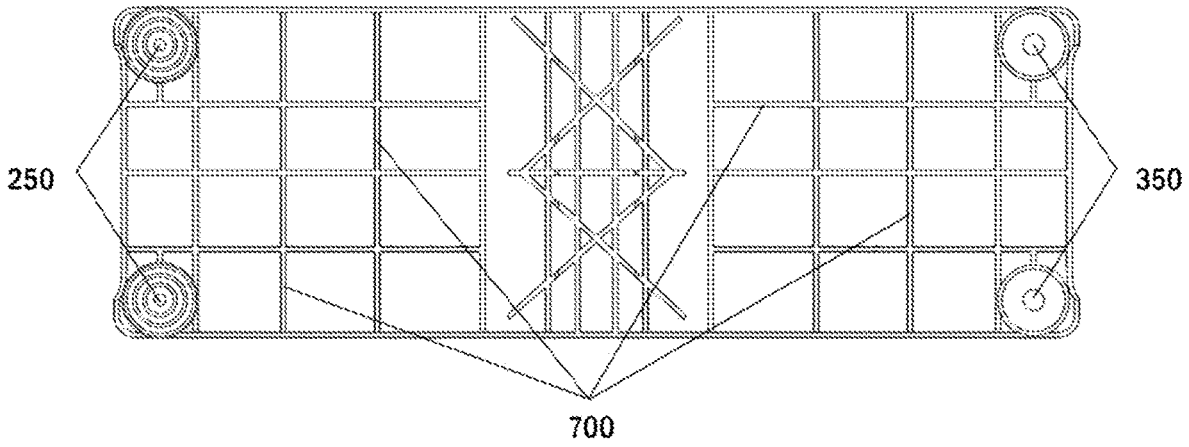
FIG. 5 illustrates a bottom view of a first embodiment of an over-the-tub double-sided step stool, as contemplated by the present disclosure.

The illustration of FIG. 5 illustrates a bottom view of a first embodiment of an over-the-tub double-sided step stool. The figure illustrates a plurality of non-slip foot attachments 250 and a plurality of suction foot attachments 350. The figure further illustrates a plurality of structural ribs 700.

By reference to the illustrations in FIGS. 2 through 5, a plurality of non-slip foot attachments 250 may be positioned such that they engage a bathroom floor and provide resistance to positional changes of an over-the-tub double-sided step stool. A plurality of suction foot attachments 350 may be positioned such that they engage a bathtub floor and provide resistance to positional changes of an over-the-tub double-sided step stool.

Figure 6:
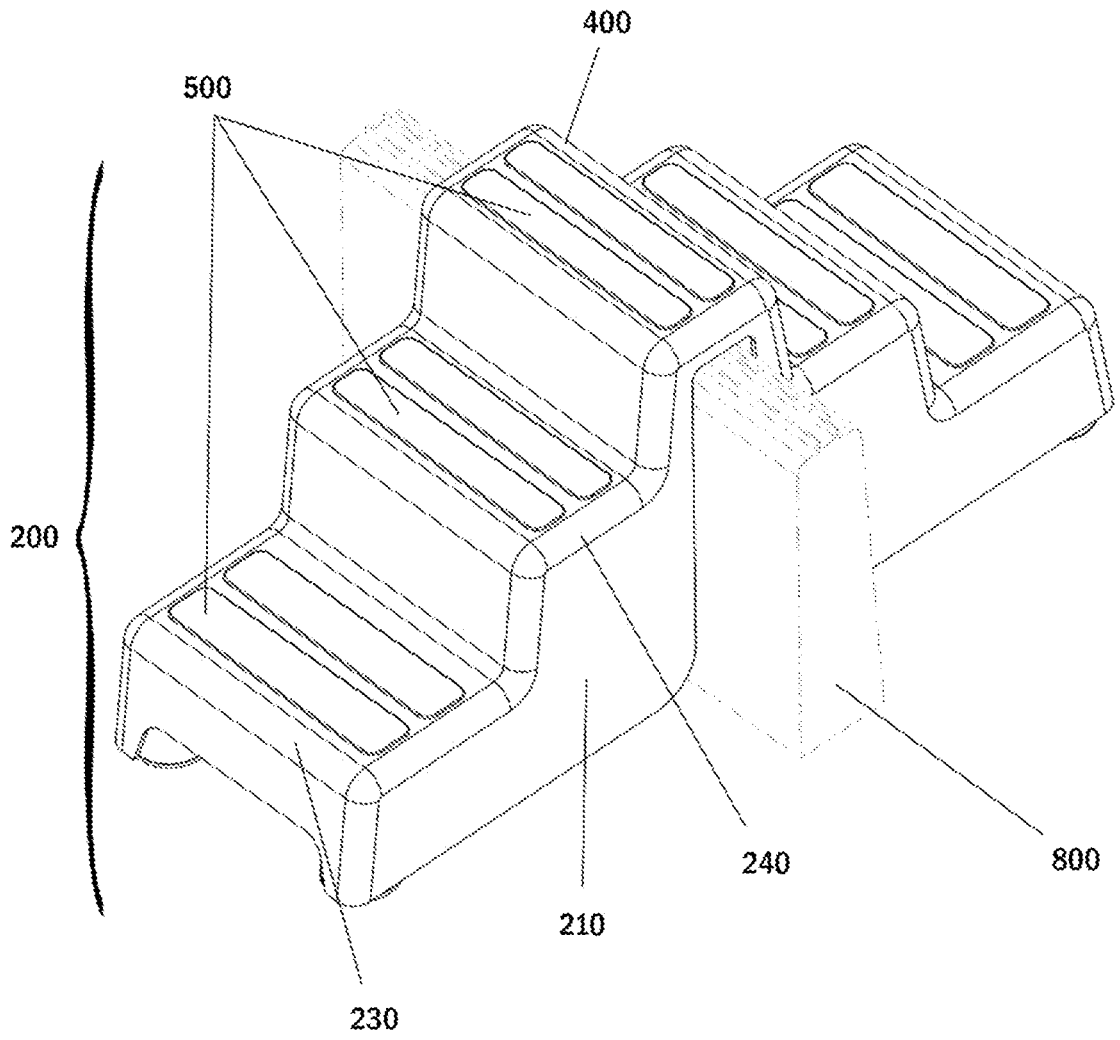
FIG. 6 illustrates top isometric view of a first embodiment of an over-the-tub double-sided step stool installed on a tub side wall, as contemplated by the present disclosure.

The illustration of FIG. 6 illustrates top isometric view of a first embodiment of an over-the-tub double-sided step stool installed on a tub side wall. The figure illustrates an outer side 200 having a first side 210. Said outer side 200 further comprises a first step 230 and a second step 240. The figure further illustrates a top step 400, a plurality of non-slip surfaces 500, and a tub wall 800.

Figure 7:
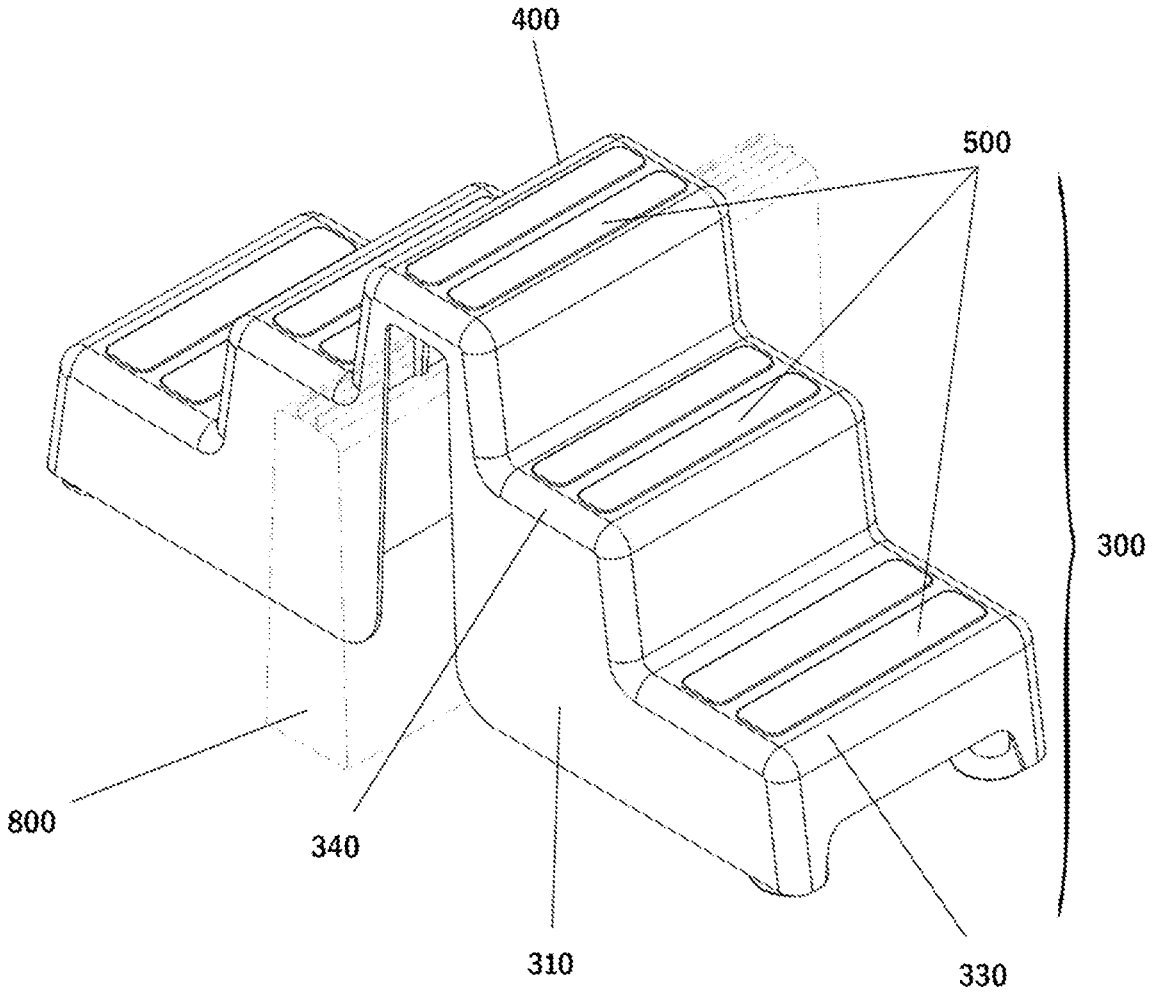
FIG. 7 illustrates top isometric view of a first embodiment of an over-the-tub double-sided step stool installed on a tub side wall, as contemplated by the present disclosure.

The illustration of FIG. 7 illustrates top isometric view of a first embodiment of an over-the-tub double-sided step stool installed on a tub side wall. The figure illustrates an inner side 300 having a first side 310. Said inner side 300 further comprises a first step 330 and a second step 340. The figure further illustrates a top step 400, a plurality of non-slip surfaces 500, and a tub wall 800.

By reference to the illustrations in FIGS. 6 and 7, an over-the-tub double-sided step stool comprising, at least, an outer side and an inner side may be placed over a standard bathtub wall such that said bathtub wall is positioned within a cavity created by a proximal edge of an outer side 200, a proximal edge of an inner side 300, and a proximal edge of a top step 400.

Figure 8:
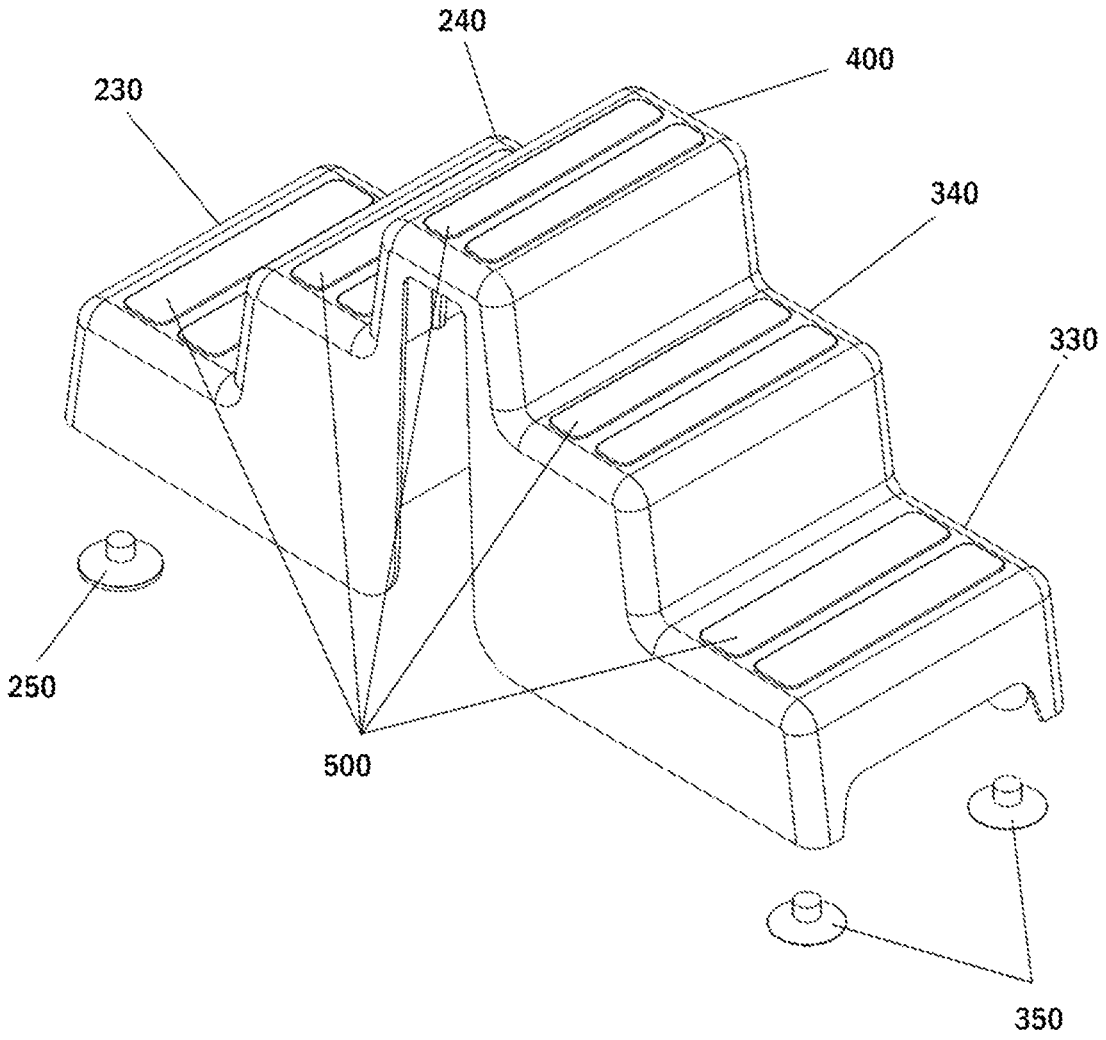
FIG. 8 illustrates a top isometric exploded view of a first embodiment of an over-the-tub double-sided step stool, as contemplated by the present disclosure.

The illustration of FIG. 8 illustrates a top isometric exploded view of a first embodiment of an over-the-tub double-sided step stool. The figure illustrates a first step 230 of an outer side 200, a second step 240 of an outer side 200, a first step 330 of an inner side 300, and a second step 340 of an inner side 300. Also shown are a top step 400 and a plurality of non-slip surfaces 500. The figure further illustrates a plurality of non-slip foot attachments 250 and a plurality of suction foot attachments 350.

Figure 9:
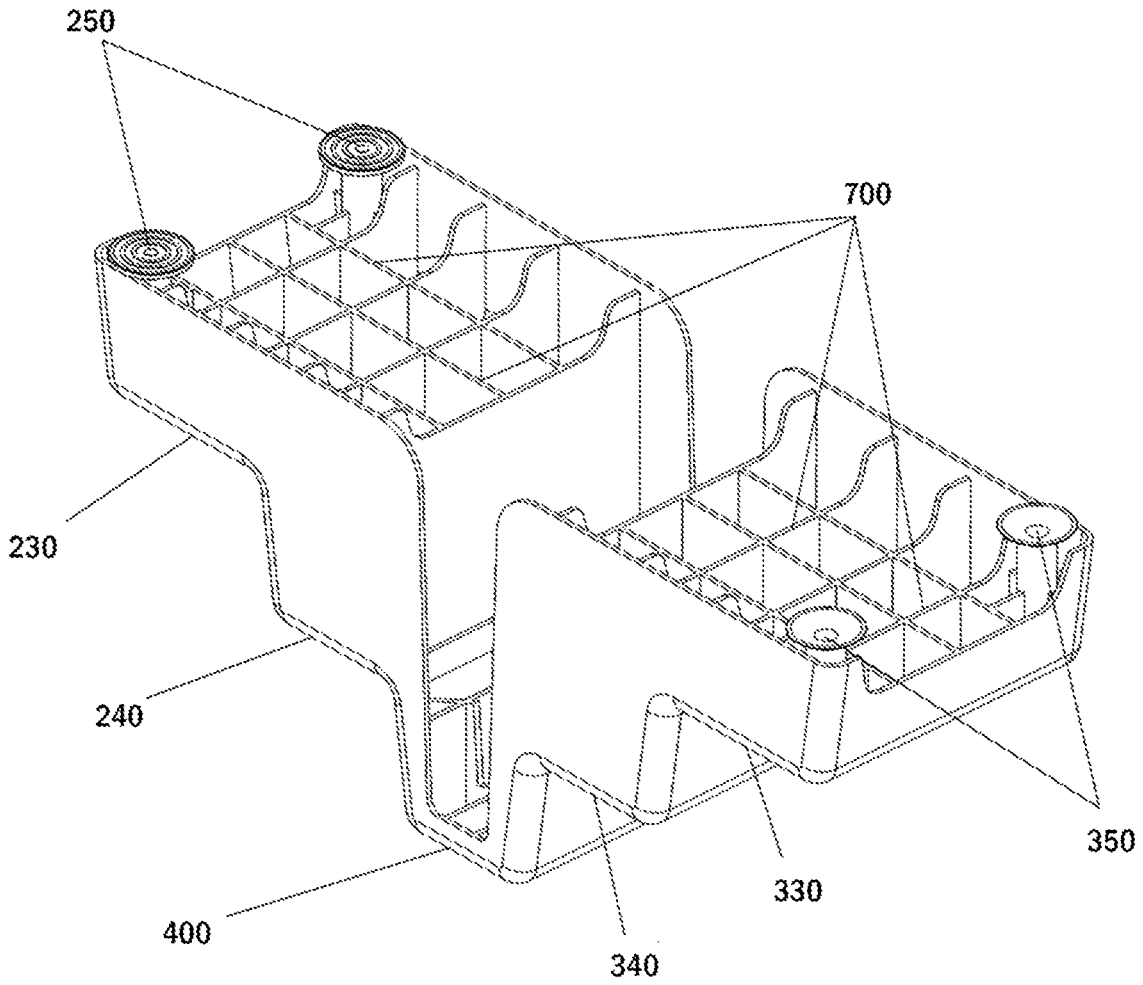
FIG. 9 illustrates a bottom isometric view of a first embodiment of an over-the-tub double-sided step stool, as contemplated by the present disclosure.

The illustration of FIG. 9 illustrates a bottom isometric view of a first embodiment of an over-the-tub double-sided step stool. The figure illustrates a first step 230 of an outer side 200, a second step 240 of an outer side 200, a first step 330 of an inner side 300, and a second step 340 of an inner side 300. Also shown are a top step 400 and a plurality of structural ribs 700. The figure further illustrates a plurality of non-slip foot attachments 250 and a plurality of suction foot attachments 350.

Figure 10:
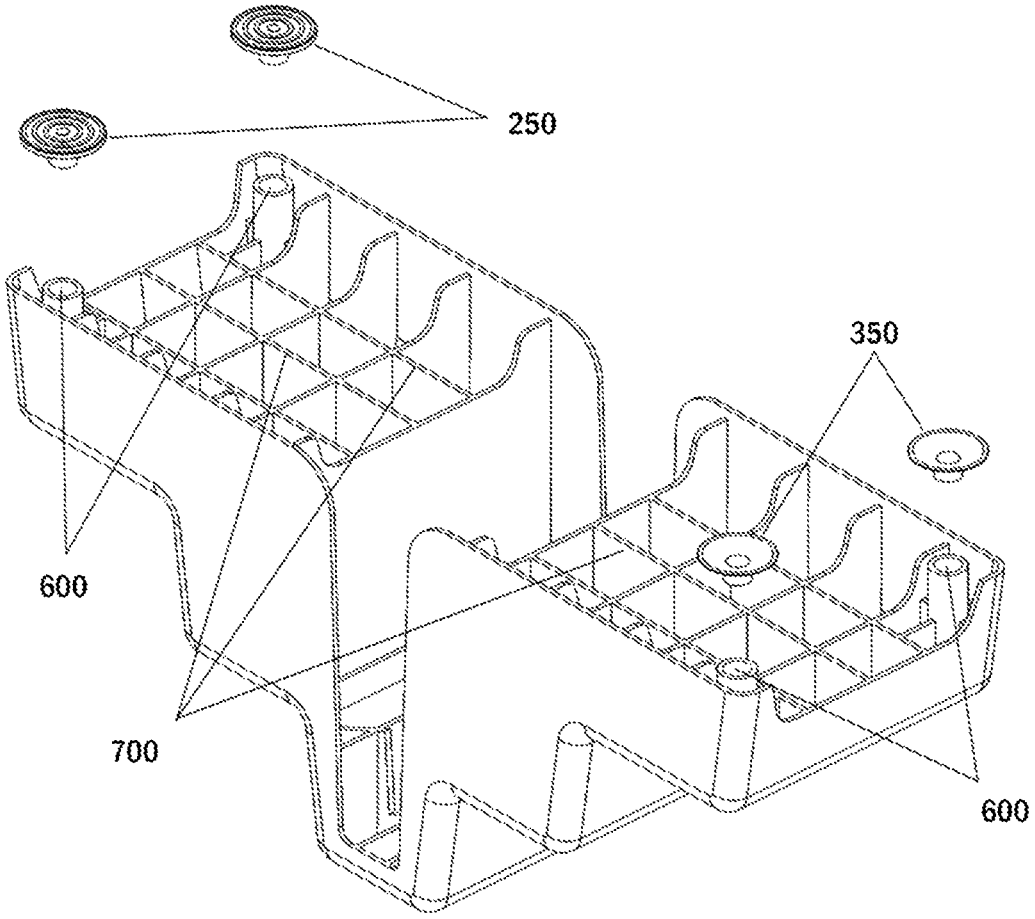
FIG. 10 illustrates a bottom isometric exploded view of a first embodiment of an over-the-tub double-sided step stool, as contemplated by the present disclosure.

The illustration of FIG. 10 illustrates a bottom isometric exploded view of a first embodiment of an over-the-tub double-sided step stool. The figure illustrates a plurality of attachment receivers 600 and a plurality of structural ribs 700. The figure further illustrates a plurality of non-slip foot attachments 250 and a plurality of suction foot attachments 350.

Figure 11:
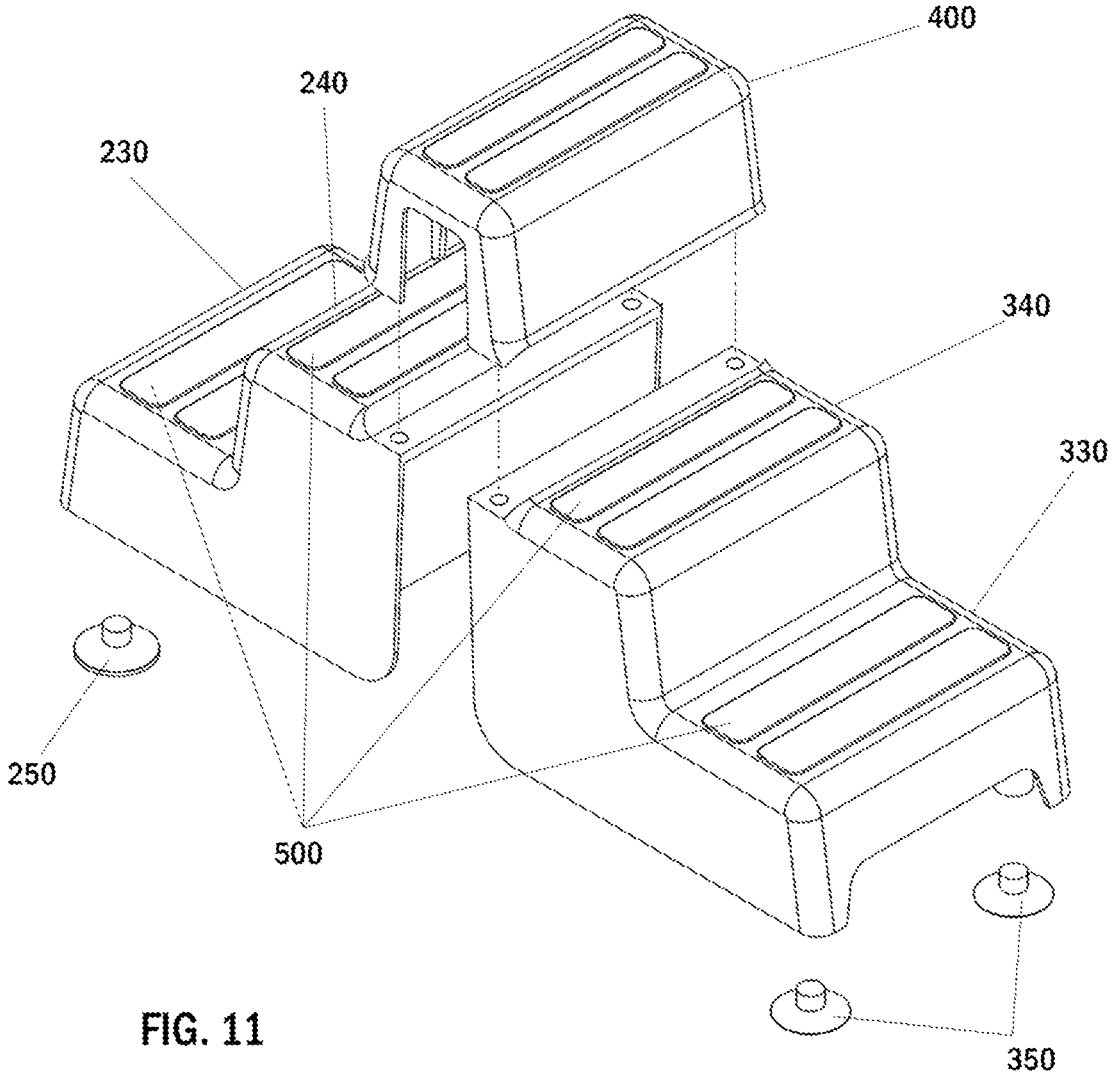
FIG. 11 illustrates a top isometric exploded view of a second embodiment of an over-the-tub double-sided step stool, as contemplated by the present disclosure.

The illustration of FIG. 11 illustrates a top isometric exploded view of a second embodiment of an over-the-tub double-sided step stool. The figure illustrates a first step 230 of an outer side 200, a second step 240 of an outer side 200, a first step 330 of an inner side 300, and a second step 340 of an inner side 300. Also shown are a top step 400 and a plurality of non-slip surfaces 500. The figure further illustrates a plurality of non-slip foot attachments 250 and a plurality of suction foot attachments 350.

Figure 12:
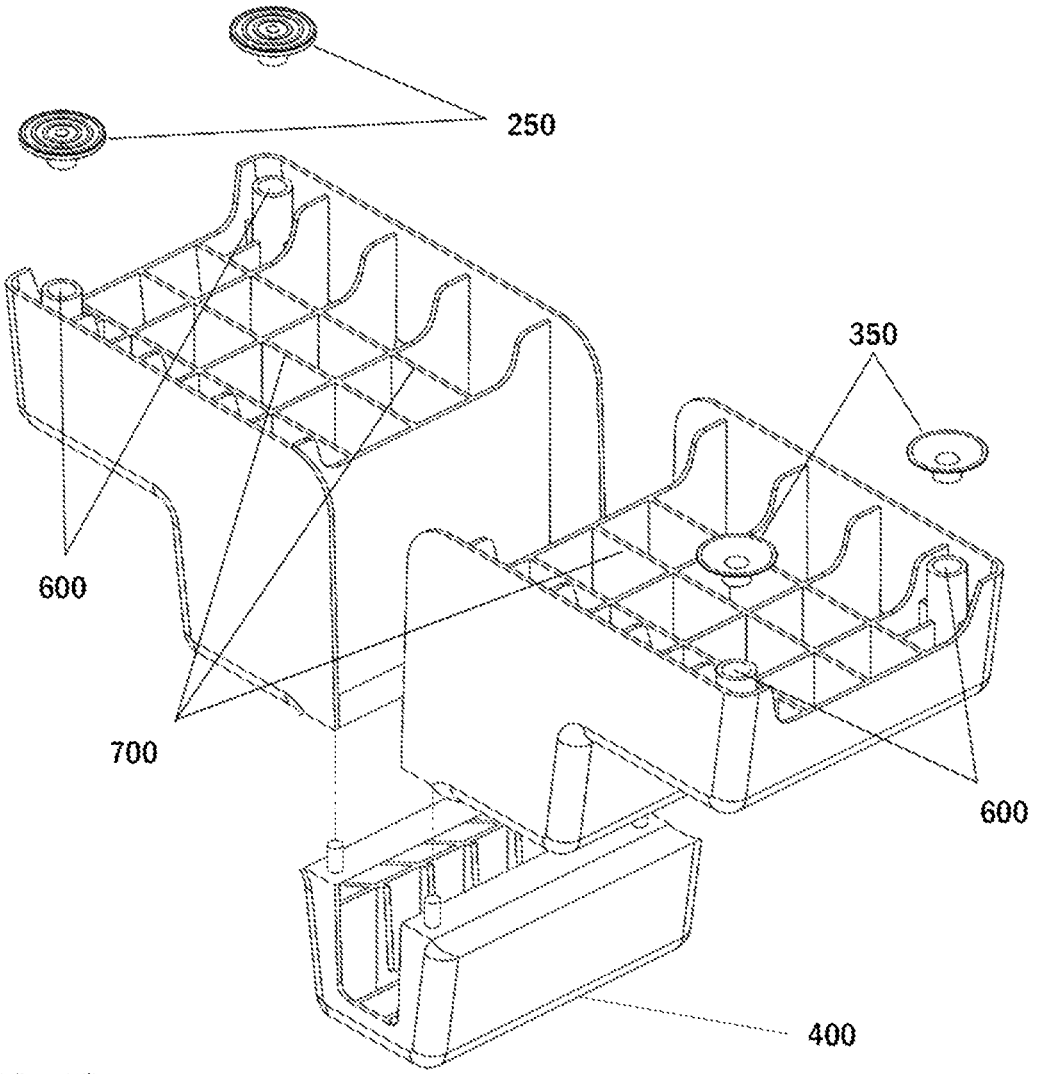
FIG. 12 illustrates a bottom isometric exploded view of a second embodiment of an over-the-tub double-sided step stool, as contemplated by the present disclosure.

The illustration of FIG. 12 illustrates a bottom isometric exploded view of a second embodiment of an over-the-tub double-sided step stool. The figure illustrates a plurality of attachment receivers 600 and a plurality of structural ribs 700. The figure further illustrates a plurality of non-slip foot attachments 250 and a plurality of suction foot attachments 350.

By reference to the illustration in FIGS. 11 and 12, the second embodiment disclosed herein may comprise a solid, multi-piece main body consisting of various subcomponents that may be removably attached to one another, said subcomponents forming a cavity into which may be positioned a standard bathtub wall. Said subcomponents may be itemized as an outer side 200, an inner side 300, and a top step 400. The attachments of said subcomponents may also be adjustable to accommodate variations in bathtub wall sizes.

The over-the-tub double-sided step stool disclosed herein may be substantially constructed of any suitable material or combination of materials, but typically is constructed of a resilient material or combination of materials such that the combination is resistant to flexing and damage as a result of compression, flexion, or submersion in water. As an example, and without limiting the scope of the present invention, various exemplary embodiments of an over-the-tub double-sided step stool may be substantially constructed of one or more materials of plastic, rubber, polyvinyl chloride, fiberglass, carbon fiber, or combinations thereof. Various exemplary embodiments of a plurality of non-slip foot attachments 250 or a plurality of suction foot attachments 350 may be substantially constructed of one or more materials of plastic, rubber, polyvinyl chloride, silicon, elastane, latex, or combinations thereof. Additionally, one or more additional materials may be added to impart the desired amount of resiliency or elasticity, such as elastane, rubber, or latex. Note with respect to the materials of construction, it is not desired nor intended to thereby unnecessarily limit the present invention by reason of such disclosure.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

I claim:

1. An over-the-tub double-sided step stool, comprising:

an outer side;

an inner side;

a top step;

an outer structural support;

an inner structural support;

a top structural support;

a plurality of non-slip foot attachments; and a plurality of suction foot attachments;

wherein said outer side further comprises a left side, a right side, a first step, and a second step;

wherein said first step and said second step of said outer side each comprise a vertical plane and a horizontal plane connected at a right angle with said vertical plane extending down from a distal edge of said horizontal plane;

wherein a bottom edge of said vertical plane of said second step of said outer side is attached to a proximal edge of said horizontal plane of said first step of said outer side such that said vertical plane of said second step of said outer side extends up and they form a two outer steps combination;

wherein said left side and said right side of said outer side comprise vertical surfaces having an upper edge attached to a first lateral edge and a second lateral edge, respectively, of said two outer steps combination such that they are perpendicular to said vertical plane of said first step and said second step and such that they extend down;

wherein said inner side further comprises a left side, a right side, a first step, and a second step;

wherein said first step and said second step of said inner side each comprise a vertical plane and a horizontal plane connected at a right angle with said vertical plane extending down from a distal edge of said horizontal plane;

wherein a bottom edge of said vertical plane of said second step of said inner side is attached to a proximal edge of said horizontal plane of said first step of said inner side such that said vertical plane of said second step of said inner side extends up and they form a two inner steps combination;

wherein said left side and said right side of said inner side comprise vertical surfaces having an upper edge attached to a first lateral edge and a second lateral edge, respectively, of said two inner steps combination such that they are perpendicular to said vertical plane of said first step and said second step and such that they extend down;

wherein said top step further comprises an outer vertical plane, an inner vertical plane, a horizontal plane, a left side, and a right side;

wherein a top edge of said outer vertical plane of said top step is attached to a distal edge of said horizontal plane of said top step such that said outer vertical plane extends down at a right angle and a top edge of said inner vertical plane of said top step is attached to a proximal edge of said horizontal plane of said top step such that said inner vertical plane extends down at a right angle;

wherein a bottom edge of said outer vertical plane of said top step is attached to a proximal edge of said horizontal plane of said second step of said outer side such that said outer vertical plane of said top step extends up at a right angle;

wherein a bottom edge of said inner vertical plane of said top step is attached to a proximal edge of said horizontal plane of said second step of said inner side such that said inner vertical plane of said top step extends up at a right angle;

wherein said left side and said right side of said top step comprise vertical surfaces having an upper edge attached to a first lateral edge and a second lateral edge, respectively, of said horizontal plane of said top step such that they are perpendicular to said inner vertical plane and said outer vertical plane of said top step and such that they extend down;

wherein said outer structural support is located within an inner cavity of said outer side;

wherein said inner structural support is located within an inner cavity of said inner side;

wherein said top structural support is located within an inner cavity of said top step;

wherein said plurality of non-slip foot attachments are attached to said outer side; and wherein said plurality of suction foot attachments are attached to said inner side.

2. The invention of claim 1, further comprising:

a plurality of non-slip surfaces;

wherein said plurality of non-slip surfaces are attached to an upper surface of said horizontal plane of said first step of said outer side, an upper surface of said horizontal plane of said second step of said outer side, an upper surface of said horizontal plane of said first step of said inner side, an upper surface of said horizontal plane of said second step of said inner side, and an upper surface of said horizontal plane of said top step.

3. The invention of claim 2, wherein said plurality of non-slip foot attachments are attached to a bottom side of said outer side; and wherein said plurality of suction foot attachments are attached to a bottom side of said inner side.

4. The invention of claim 2, wherein said plurality of non-slip foot attachments are attached to said outer structural support of said outer side; and wherein said plurality of suction foot attachments are attached to said outer structural support of said inner side.

5. The invention of claim 2, wherein said plurality of non-slip surfaces are molded into said upper surface of said horizontal plane of said first step of said outer side, said upper surface of said horizontal plane of said second step of said outer side, said upper surface of said horizontal plane of said first step of said inner side, said upper surface of said horizontal plane of said second step of said inner side, and said upper surface of said horizontal plane of said top step.

6. The invention of claim 2, wherein said bottom edge of said outer vertical plane of said top step is permanently attached to said proximal edge of said horizontal plane of said second step of said outer side; and wherein said bottom edge of said inner vertical plane of said top step is permanently attached to said proximal edge of said horizontal plane of said second step of said inner side.

7. The invention of claim 2, wherein said bottom edge of said outer vertical plane of said top step is removably attached to said proximal edge of said horizontal plane of said second step of said outer side; and wherein said bottom edge of said inner vertical plane of said top step is removably attached to said proximal edge of said horizontal plane of said second step of said inner side.

8. An over-the-tub double-sided step stool, comprising:

an outer side;

an inner side;

a top step;

an outer structural support;

an inner structural support;

a top structural support;

a plurality of non-slip foot attachments; and a plurality of suction foot attachments;

wherein said outer side further comprises a left side, a right side, a first step, and a second step;

wherein said first step and said second step of said outer side each comprise a vertical plane and a horizontal plane connected at an angle with said vertical plane extending down from a distal edge of said horizontal plane;

wherein a bottom edge of said vertical plane of said second step of said outer side is attached to a proximal edge of said horizontal plane of said first step of said outer side such that said vertical plane of said second step of said outer side extends up and they form a two outer steps combination;

wherein said left side and said right side of said outer side comprise vertical surfaces having an upper edge attached to a first lateral edge and a second lateral edge, respectively, of said two outer steps combination such that they are offset at an angle relative to said vertical plane of said first step and said second step and such that they extend down;

wherein said inner side further comprises a left side, a right side, a first step, and a second step;

wherein said first step and said second step of said inner side each comprise a vertical plane and a horizontal plane connected at an angle with said vertical plane extending down from a distal edge of said horizontal plane;

wherein a bottom edge of said vertical plane of said second step of said inner side is attached to a proximal edge of said horizontal plane of said first step of said inner side such that said vertical plane of said second step of said inner side extends up and they form a two inner steps combination;

wherein said left side and said right side of said inner side comprise vertical surfaces having an upper edge attached to a first lateral edge and a second lateral edge, respectively, of said two inner steps combination such that they are offset at an angle relative to said vertical plane of said first step and said second step and such that they extend down;

wherein said top step further comprises an outer vertical plane, an inner vertical plane, a horizontal plane, a left side, and a right side;

wherein a top edge of said outer vertical plane of said top step is attached to a distal edge of said horizontal plane of said top step such that said outer vertical plane extends down at an angle and a top edge of said inner vertical plane of said top step is attached to a proximal edge of said horizontal plane of said top step such that said inner vertical plane extends down at an angle;

wherein a bottom edge of said outer vertical plane of said top step is attached to a proximal edge of said horizontal plane of said second step of said outer side such that said outer vertical plane of said top step extends up at an angle;

wherein a bottom edge of said inner vertical plane of said top step is attached to a proximal edge of said horizontal plane of said second step of said inner side such that said inner vertical plane of said top step extends up at an angle;

wherein said left side and said right side of said top step comprise vertical surfaces having an upper edge attached to a first lateral edge and a second lateral edge, respectively, of said horizontal plane of said top step such that they are offset at an angle relative to said inner vertical plane and said outer vertical plane of said top step and such that they extend down;

wherein said outer structural support is located within an inner cavity of said outer side;

wherein said inner structural support is located within an inner cavity of said inner side;

wherein said top structural support is located within an inner cavity of said top step;

wherein said plurality of non-slip foot attachments are attached to said outer side; and wherein said plurality of suction foot attachments are attached to said inner side.

9. The invention of claim 8, further comprising:

a plurality of non-slip surfaces;

wherein said plurality of non-slip surfaces are attached to an upper surface of said horizontal plane of said first step of said outer side, an upper surface of said horizontal plane of said second step of said outer side, an upper surface of said horizontal plane of said first step of said inner side, an upper surface of said horizontal plane of said second step of said inner side, and an upper surface of said horizontal plane of said top step.

10. The invention of claim 9, wherein said plurality of non-slip foot attachments are attached to a bottom side of said outer side; and wherein said plurality of suction foot attachments are attached to a bottom side of said inner side.

11. The invention of claim 9, wherein said plurality of non-slip foot attachments are attached to said outer structural support of said outer side; and wherein said plurality of suction foot attachments are attached to said outer structural support of said inner side.

12. The invention of claim 9, wherein said plurality of non-slip surfaces are molded into said upper surface of said horizontal plane of said first step of said outer side, said upper surface of said horizontal plane of said second step of said outer side, said upper surface of said horizontal plane of said first step of said inner side, said upper surface of said horizontal plane of said second step of said inner side, and said upper surface of said horizontal plane of said top step.

13. The invention of claim 9, wherein said bottom edge of said outer vertical plane of said top step is permanently attached to said proximal edge of said horizontal plane of said second step of said outer side; and wherein said bottom edge of said inner vertical plane of said top step is permanently attached to said proximal edge of said horizontal plane of said second step of said inner side.

14. The invention of claim 9, wherein said bottom edge of said outer vertical plane of said top step is removably attached to said proximal edge of said horizontal plane of said second step of said outer side; and wherein said bottom edge of said inner vertical plane of said top step is removably attached to said proximal edge of said horizontal plane of said second step of said inner side.

* * * * *